US007699450B2

(12) United States Patent
Furukawa et al.

(10) Patent No.: US 7,699,450 B2
(45) Date of Patent: Apr. 20, 2010

(54) INK SUPPLYING CONTAINER AND IMAGE FORMING APPARATUS

(75) Inventors: Juichi Furukawa, Kanagawa (JP); Toshitaka Osanai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 773 days.

(21) Appl. No.: 11/516,856

(22) Filed: Sep. 6, 2006

(65) Prior Publication Data

US 2007/0058009 A1 Mar. 15, 2007

(30) Foreign Application Priority Data

Sep. 12, 2005 (JP) ..... 2005-263241

(51) Int. Cl.
*B41J 2/175* (2006.01)

(52) U.S. Cl. ..... 347/85

(58) Field of Classification Search ..... 347/7, 347/84, 85

See application file for complete search history.

(56) References Cited

U.S. PATENT DOCUMENTS 5,608,437 A * 3/1997 Iwata et al. ..... 347/86
5,886,718 A * 3/1999 Johnson et al. ..... 347/85
6,663,233 B2 * 12/2003 Otsuka et al. ..... 347/85
6,685,307 B2 * 2/2004 Dowell et al. ..... 347/85
2006/0087530 A1 4/2006 Furukawa

FOREIGN PATENT DOCUMENTS

| | | |
|---|---|---|
| JP | 2001-162834 | 6/2001 |
| JP | 2001-187459 | 7/2001 |
| JP | 2002-370374 | 12/2002 |
| JP | 2003-231275 | 8/2003 |
| JP | 3581675 | 7/2004 |

* cited by examiner

*Primary Examiner*—Anh T. N. Vo
(74) *Attorney, Agent, or Firm*—Cooper & Dunham LLP

(57) ABSTRACT

An ink supplying container is disclosed. In the ink supplying container, when the internal pressure of an ink container is made a positive pressure which is higher than atmospheric pressure so that nozzles of a recording head are cleaned and recovered by discharging a small amount of ink, a volume control unit restrains a flexible member of the ink container from expanding. When the internal pressure of the ink container is made a negative pressure optimal for printing which is lower than the atmospheric pressure so that a letter and/or an image is printed on a recording medium by the recording head, the volume control unit does not restrain the flexible member from expanding, and the volume of the ink container is maintained at almost the same volume as that at the time when the internal pressure of the ink container is made the positive pressure.

10 Claims, 12 Drawing Sheets

INK SUPPLYING CONTAINER AND IMAGE FORMING APPARATUS

BACKGROUND

1. Technical Field

This disclosure generally relates to an ink supplying container which stores ink by which a letter and/or an image is recorded on a recording medium by being ejected from a recording head and an image forming apparatus using the ink supplying container in which the amount of waste ink is reduced when cleaning and recovering nozzles of the recording head are executed by discharging the ink from the nozzles of the recording head by applying pressure to the ink in the ink supplying container using a pressure applying recovering method.

2. Description of the Related Art

An inkjet recording apparatus provides a recording head, a carrying belt which is rotated by a driving power transferring mechanism having a driving motor, pulleys, a driving belt, and so on, and a recording medium supplying tray. The carrying belt carries a recording medium stored in the recording medium supplying tray. A letter and/or an image is recorded on the recording medium by ejecting ink from the recording head while the recording medium is carried by the carrying belt. The inkjet recording apparatus is used in a general-use printing apparatus, a copying apparatus, a facsimile apparatus, and so on. In addition, recently, the inkjet recording system has been used to manufacture a component such as an industrial printed circuit board which needs precise processes by ejecting a solvent other than ink.

Recently, the recording speed of the inkjet recording apparatus has been high, and a large amount of recording has been executed in a short time. Therefore, the amount of ink which is consumed in the inkjet recording apparatus has been increased. In order to perform the large amount of recording, an ink tank having a large capacity is disposed at a position where a recording head is not disposed and ink stored in the ink tank is supplied to a sub tank disposed near the recording head by using an ink supplying unit such as a pump. With this, the large amount of recording can be executed.

As the recovering method of the recording head in the inkjet recording apparatus, there are a suction recovering method and pressure applying recovering method. As shown in Patent document 1, in the suction recovering method, the surface of nozzles of the recording head is covered with a cap connected to a suction pump, the pressure inside the cap is reduced by using the suction pump, and ink in the nozzles is suctioned. As shown in Patent Documents 2 and 3, in the pressure applying recovering method, pressure is applied to ink inside the recording head from an ink supplying route by using pressure pump and the ink is discharged from the nozzles.

In the suction recovering method, when the size of the recording head is large, a large cap is needed to cover the recording head; therefore, it is difficult to seal the surface of the nozzles with the cap. In addition, when the size of the recording head is large, a large reduction of the pressure is required for suctioning the ink. Therefore, it is not suitable that the suction recovering method be used in an inkjet recording apparatus which has a long-length recording head.

On the other hand, in the pressure applying recovering method, when the size of the recording head is large, a moisture retaining property is required for the cap which covers the surface of the nozzles of the recording head; however, excessive sealing performance is not required; therefore, the structure is simple. Consequently, it is preferable that the pressure applying recovering method be used in the inkjet recording apparatus using the long-length recording head.

In addition, in the inkjet recording apparatus, when printing is executed, in the recording head, the ink must not overflow from the nozzles. That is, the ink must be supplied to the recording head in a condition where the recording head is has a negative internal pressure so that a meniscus can be stably maintained. When the pressure applying recovering method is used, after discharging ink from the nozzles by changing the internal pressure in the recording head from a negative pressure to a positive pressure by using a pressure applying unit, the internal pressure in the recording head must be returned from the positive pressure to the negative pressure, which is optimal to execute printing, so as to execute again the printing every time after the recovering operations. In this, "positive pressure" signifies that the internal pressure in the ink supplying route is higher than atmospheric pressure, and "negative pressure" signifies that the internal pressure in the ink supplying route is lower than the atmospheric pressure.

As a method to give the recording head a negative internal pressure, there are a method of utilizing a water head by causing the height of the ink tank having a large capacity to be variable, and a method of utilizing the change of the volume of a sub tank. In the method of utilizing the change of the volume of the sub tank, since the height of the ink tank is not changed, the printing is stably executed and layout designing of the inkjet recording apparatus is not restrained. When the internal pressure of the recording head is made negative by utilizing the change of the volume of the sub tank, the internal pressure of the sub tank and the internal pressure of the recording head must be returned to an optimal negative pressure so that the printing can be executed again every time after recovering operations (restoring the nozzles to normal performance) of the nozzles of the recording head, that is, after changing the internal pressure of the sub tank from the negative pressure to the positive pressure.

FIG. 12 is a diagram showing a print head unit of an inkjet recording apparatus according to Patent Document 2. As shown in FIG. 12, in the print head unit, a sub tank 51 whose capacity is variable and a retractable stopper 52 which controls the expansion of the sub tank 51 are included in a container 53. The sub tank 51 is expanded by supplying ink to the sub tank 51 from an ink tank 50 while the pressure inside the container 53 is reduced by a pump 54, and the expanded sub tank 51 is stopped by the stopper 52. Then, the recovering operations are applied to a recording head 55. Therefore, after discharging ink in the sub tank 51 from the nozzles of the recording head 55 by making the pressure inside the sub tank 51 high, the pressure inside the sub tank 51 is made negative by moving the sub tank 51 away from the stopper 52 by causing the internal pressure of the sub tank 51 to be small.

In an inkjet recording apparatus in Patent Document 3, a sub tank whose capacity is variable is disposed. When recovering operations of nozzles of a recording head are executed, ink is supplied to the sub tank and the ink in the sub tank is discharged from nozzles of the recording head at a certain pressure. A part of the ink in the sub tank is discharged to the outside by stopping the supply of the ink to the sub tank and making the pressure inside the sub tank a negative pressure by causing the volume in the sub tank to be small.

[Patent Document 1] Japanese Patent No. 3581675

[Patent Document 2] Japanese Laid-Open Patent Application No. 2002-370374

[Patent Document 3] Japanese Laid-Open Patent Application No. 2001-162834

However, in the above pressure applying recovering method, every time at the recovering operations of the nozzles of the recording head, the change of the volume of the sub tank is utilized, that is, the internal pressure of the sub tank and the internal pressure of the recording head are changed from the negative pressure to the positive pressure and the pressure is returned to an optimal negative pressure which is suitable for printing. Consequently, the volume of ink corresponding to a difference between the volume of the sub tank when the internal pressure of the sub tank becomes maximum and that when the internal pressure of the sub tank becomes a negative pressure suitable for printing is forced to be discharged. Therefore, every time at the recovering operations, the amount of the waste ink becomes large. Especially, in an inkjet recording apparatus using a long-length recording head, the amount of the waste ink becomes remarkably large, and the ink cannot be effectively used.

SUMMARY

In a preferred embodiment of this disclosure, there is provided an ink supplying container and an image forming apparatus using the ink supplying container in which the amount of waste ink that is generated every time during recovering operations on nozzles of a recording head using a pressure applying recovering method is reduced and the ink is effectively utilized.

In a first aspect of this disclosure, there is provided an ink supplying container configured to store ink supplied from an ink storing tank and supply the ink to a recording head having nozzles. The ink supplying container includes an ink container including a flexible member at least one side of the ink container; and a volume control unit being disposed to face the flexible member of the ink container, the volume control unit restraining the flexible member from expanding when the internal pressure of the ink container is made the positive pressure, and does not restraining the flexible member from expanding when the internal pressure of the ink container is made the negative pressure, where the negative pressure is lower than atmospheric pressure and the positive pressure is higher than the atmospheric pressure.

According to a second aspect, the volume control unit does not restrains the flexible member from expanding when the internal pressure is made a negative pressure to eject the ink by the recording head for printing, and the volume control unit restrains the flexible member from expanding when the internal pressure is made a positive pressure to clean and recover the nozzle of the recording head.

According to a third aspect, the volume control unit includes a stopping unit having a shape conforming to the shape of the one side of the flexible member at one end at the time when the internal pressure of the ink container is made the negative pressure; a moving unit which moves the stopping unit forward or backward for the flexible member of the ink container; and a position detecting unit which determines a position where the stopping unit is stopped when the stopping unit is moved forward to the flexible member.

According to a fourth aspect, the ink supplying container further includes a position variable unit which makes the position where the position detecting unit is disposed variable.

According to a fifth aspect, the volume control unit further includes a pressure chamber which contacts the flexible member of the ink container and makes the internal pressure of the pressure chamber the atmospheric pressure when the internal pressure of the ink container is the negative pressure and applies pressure to the inside of the pressure chamber when the internal pressure of the ink container is made the positive pressure.

According to the sixth aspect, when pressure is applied to the inside of the pressure chamber, the volume control unit makes the internal pressure of the pressure chamber almost the same pressure as the internal pressure of the ink container at the time when the internal pressure of the ink container is made the positive pressure.

According to a seventh aspect of this disclosure, there is provided an ink supplying container configured to store ink supplied from an ink storing tank and supply the ink to a recording head having nozzles. The ink supplying container includes an ink container including a flexible member at one side of the ink container and an ink volume maintaining unit configured to maintain the volume of the ink container at a predetermined amount when the internal pressure of the ink container is made the nagative pressure and when the internal pressure of the ink container is made the positive pressure container where the negative pressure is lower than atmospheric pressure and the positive is higher than the atmospheric pressure.

According to an eight aspect of this disclosure, the volume maintain unit makes the internal pressure a negative pressure when the recording head ejects the ink for printing, and the volume maintain unit makes the internal pressure a positive pressure when the nozzle of the recording head is to be cleaned and recovered.

According to the ninth aspect, the ink volume maintaining unit supplies a part of the ink container to an auxiliary tank when the internal pressure of the ink container is made the negative pressure, and returns the part of the ink supplied to the auxiliary tank to the ink container when the internal pressure of the ink container is made the positive pressure.

According to the tenth aspect, the ink volume maintaining unit includes an ink staying section disposed in the ink container contacting the uppermost position of the flexible member and an auxiliary tank connected to the ink staying section which auxiliary tank stores fluid in which the ink is insoluble in a part of the auxiliary tank, and supplies the fluid in the auxiliary tank to the ink staying section when the internal pressure of the ink container is made the positive pressure, and returns the fluid supplied in the ink staying section to the auxiliary tank when the internal pressure of the ink container is made the negative pressure.

According to an eleventh aspect, the ink volume maintaining unit includes an ink staying section disposed in the ink tank contacting the uppermost position of the flexible member, supplies fluid to the ink staying section when the internal pressure of the ink container is made the positive pressure, and discharges the fluid supplied in the staying section when the internal pressure of the ink container is made the negative pressure.

According to a twelfth aspect of this disclosure, there is provided an image forming apparatus including a recording head having nozzles and an ink supplying container configured to store ink supplied from an ink storing tank and supply the ink to the recording head. The ink supplying container includes an ink container including a flexible member at least one side of the ink container; and a volume control unit being disposed to face the flexible member of the ink container, the volume control unit restraining the flexible member from expanding when the internal pressure of the ink container is made the positive pressure, and does not restraining the flexible member from expanding when the internal pressure of the ink container is made the negative pressure where the negative pressure is lower than atmospheric pressure and the positive pressure is higher than the atmospheric pressure.

According to an embodiment of this disclosure, when the internal pressure of an ink container is made a positive pressure to execute cleaning and recovering operations of nozzles of a recording head, a flexible member of the ink container is restrained from expanding; and when the internal pressure of the ink container is made a negative pressure to execute printing a letter anchor an image on a recording medium, the flexible member of the ink container is not restrained from expanding. Further, the volume of the ink container at the time when the internal pressure of the ink container is made the positive pressure is maintained at almost the same volume as that of the ink container at the time when the internal pressure of the ink container is made the negative pressure optimal for printing. Therefore, by only discharging a small amount of ink from the ink container when the cleaning and recovering operations of the nozzles of the recording head are executed by pressure applying recovering method, the internal pressure of the ink container can be the negative pressure optimal for printing. With this, waste ink at the cleaning and recovering operations of the nozzles of the recording head can be reduced, where the negative pressure is lower than atmospheric pressure and the positive pressure is higher than the atmospheric pressure.

In addition, in order to restrain the flexible member of the ink container from expanding, a stopping unit is used. The stopping unit has a shape conforming to the shape of the one side of the flexible member at one end at the time when the internal pressure of the ink container is made the negative pressure. When the moving position of the stopping unit is controlled by a moving unit, the flexible member can be stably restrained from expanding.

In addition, when moving position of the stopping unit is variable, the moving position of the stopping unit can be adjusted corresponding to a change of the position of the flexible member caused by a change of environment such as temperature. Therefore, even if the environment is changed, the volume of the ink container at the time of the positive pressure can be maintained at almost the same volume as that at the time of a negative pressure optimal for printing.

In addition, pressure chamber can be disposed. The pressure chamber contacts the flexible member of the ink container and makes the internal pressure of the pressure chamber the atmospheric pressure when the internal pressure of the ink container is made the negative pressure and applies pressure to the inside of the pressure chamber when the internal pressure of the ink container is made the positive pressure. When the pressure chamber is used, the flexible member of the ink container can be restrained from expanding by a simple structure. In addition, when pressure is applied to inside the pressure chamber, if the pressure is applied so that the internal pressure of the pressure chamber is made almost the same pressure as that at the time when the internal pressure of the ink container is made the positive pressure, a breakdown of the recording head can be prevented by decreasing the influence of a rapid increase of the internal pressure of the ink container.

In addition, the ink supplying container can include an ink volume maintaining unit. The ink volume maintaining unit maintains the volume of the ink in the ink container including an auxiliary tank connected to the ink container in a predetermined amount when the internal pressure of the ink container is made the negative pressure and when the internal pressure of the ink container is made the positive pressure. Therefore, by only discharging a small amount of ink from the ink container when the cleaning and recovering operations of the nozzles of the recording head are executed by the pressure applying recovering method, the internal pressure of the ink container can be the negative pressure optimal for printing. With this, waste ink at the cleaning and recovering operations of the nozzles of the recording head can be reduced.

In addition, in an image forming apparatus using the above-mentioned ink supplying container, waste ink at the cleaning and recovering operations of the nozzles of the recording head can be largely reduced and the ink can be effectively utilized by reducing the consuming amount of the ink.

In addition, when the internal pressure of the ink container is made the positive pressure by using the stopping unit or the pressure chamber, after restraining the flexible member from expanding, the internal pressure of the ink container is made the positive pressure. With this, when the internal pressure of the ink container is made the positive pressure, the ink container is not influenced by a reaction of force when the ink is supplied to fill the ink container and the resistance of the pressure is small. Therefore, the volume change of the ink container can be easily restrained by a small force, the rapid pressure change in the ink container and the recording head can be prevented, and a reverse flow of ink in an ink supplying tube can be prevented.

BRIEF DESCRIPTION OF THE DRAWINGS

The above-mentioned and other aspects, features and advantages will become more apparent from the following detailed description when read in conjunction with the accompanying drawings, in which.

DESCRIPTION OF THE PREFERRED EMBODIMENTS

Best Mode of Carrying Out the Invention

The best mode of carrying out the present invention is described with reference to the accompanying drawings.

Figure 1:
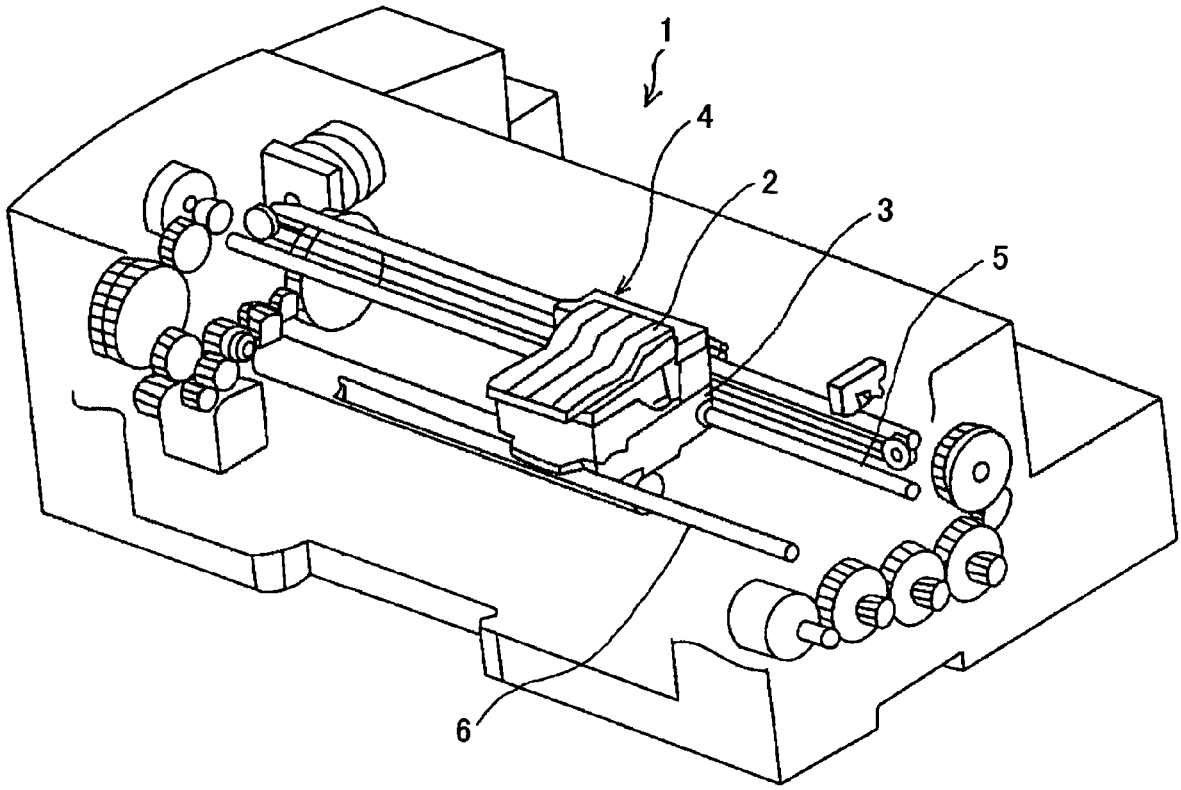
FIG. 1 is a perspective view of an image forming apparatus according to an embodiment of the present invention.

FIG. 1 is a perspective view of an image forming apparatus according to an embodiment of the present invention. In embodiments of the present invention, as the image forming apparatus, an inkjet recording apparatus of a serial scanning system is used.

As shown in FIG. 1, an inkjet recording apparatus 1 includes four sub tanks 2 which store corresponding color ink of cyan C, magenta M, yellow Y, and black Bk, and are connected to corresponding large capacity tanks (not shown) via corresponding ink supplying tubes; four recording heads 3 each having plural nozzles and to each of which the corresponding color ink is supplied from the corresponding sub tank 2; and a carriage 4 on which the four sub tanks 2 and the four recording heads 3 are disposed. When image data sent from a host apparatus (not shown) are recorded on a recording medium (not shown), based on the image data sent to a recording section (not shown), ink is ejected from the nozzles of the recording heads 3 onto the recording medium while the carriage 4 is moved in the main scanning direction along a main guide rod 5 and a sub guide rod 6. With this, a letter and/or an image is recorded on the recording medium and the recording medium is output to an outputting tray (not shown).

Figure 2:
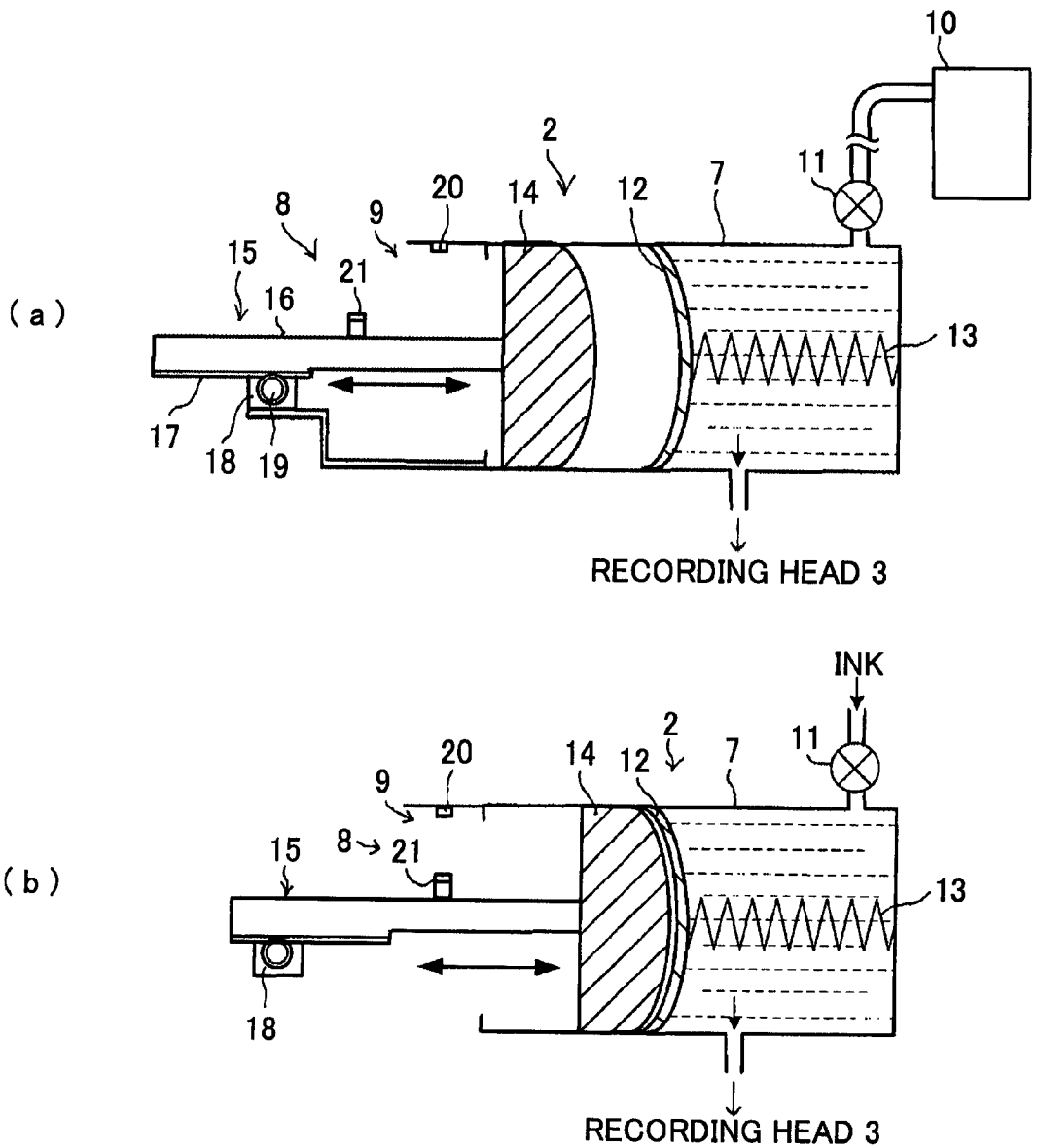
FIG. 2 is a schematic diagram of a sub tank according to a first embodiment of the present invention.

FIG. 2 is a schematic diagram of the sub tank 2 according to a first embodiment of the present invention. In FIG. 2, (a) shows a printing state in which the sub tank 2 has a negative pressure for recording a letter and/or an image, and (b) shows a state in which the sub tank 2 has a positive pressure for recovering operations of the nozzles of the recording head 3. As shown in FIG. 2, the sub tank 2 includes an ink container 7, a volume control unit 8, and a position sensor 9. The ink container 7 is connected to a large capacity ink tank 10 from which ink is supplied to the ink container 7 via an ink supplying tube and a valve 11. The ink container 7 stores the ink supplied from the ink tank 10 and supplies the stored ink to the recording head 3. A flexible member 12 made of, for example, a resin film, is disposed at the side opposite to the connection section to the ink tank 10 of the ink container 7, and a compression spring 13 for pressing the flexible member 12 is disposed in the ink container 7.

The volume control unit 8 is disposed to face the flexible member 12 of the ink container 7 and controls the volume of the ink in the ink container 7 when pressure is applied to the ink in the ink container 7. The volume control unit 8 includes a stopper 14 having a convex-shaped surface and a moving mechanism 15 which moves the stopper 14 in the right and left directions. The moving mechanism 15 includes a driving shaft 16 connected to the stopper 14 at the side opposite to the convex-shaped surface of the stopper 14, a rack 17 formed at the end part of the driving shaft 16, and a pinion 19 which is engaged with the rack 17 and is rotated by a driving motor 18. The position sensor 9 is, for example, an optical sensor, and includes a light receiving section 20 disposed at the end part of a section which holds the ink container 7 at a predetermined distance from the stopper 14 and a light emitting section 21 disposed on the driving shaft 16 of the moving mechanism 15.

Figure 3:
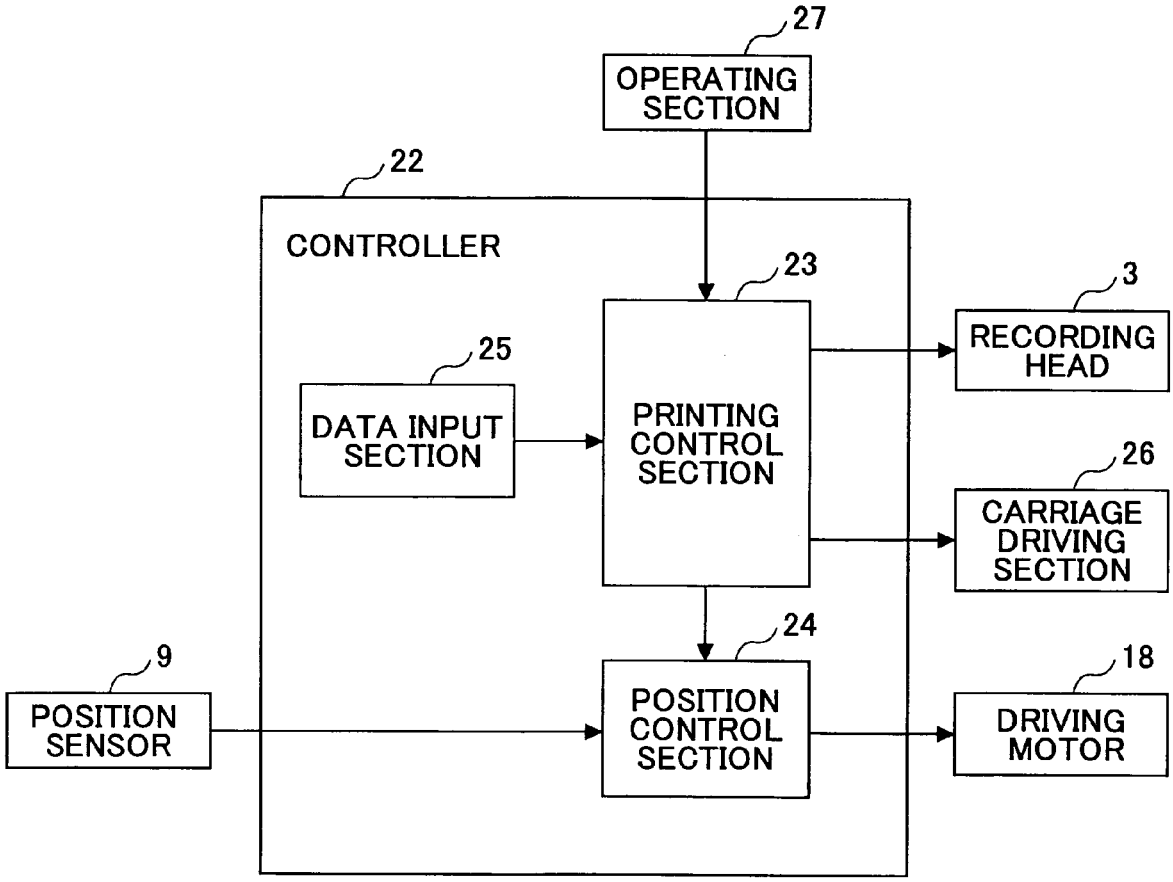
FIG. 3 is a block diagram showing a controller of an inkjet recording apparatus shown in FIG. 1.

FIG. 3 is a block diagram showing a controller 22 of the inkjet recording apparatus 1 shown in FIG. 1. As shown in FIG. 3, the controller 22 includes a printing control section 23, a position control section 24, and a data input section 25. The printing control section 23 controls operations of a carriage driving section 26 which drives the recording head 3 and the carriage 4 based on image data input to the data input section 25, and operates the position control section 24 when the recovering operations of the nozzles of the recording head 3 are executed. When the recovering operations of the nozzles of the recording head 3 are executed, the position control section 24 controls the position of the stopper 14 of the volume control unit 8 based on a signal input from the position sensor 9 of the sub tank 2 by controlling the driving motor 18.

The inkjet recording apparatus providing the sub tanks 2 executes the recovering operations of the nozzles of the recording head 3 by the pressure applying recovering method. After the recovering operations, the recording head 3 is adjusted to an optimal condition for printing a letter and/or an image.

Next, the recovering operations of the nozzles of the recording head 3 are described in detail. In a printing state, as shown in FIG. 2(*a*), the position control section 24 moves the stopper 14 away from the flexible member 12 of the ink container 7 to a predetermined initial position by driving the driving motor 18 in the volume control unit 8. In this state, a predetermined amount of ink staying the ink container 7 is discharged by a suction method, and the pressure inside the ink container 7 is made a negative pressure optimal for printing. With this state, printing is possible.

When the recovering operations of the nozzles of the recording head 3 are started, as shown FIG. 2(*b*), the position control section 24 moves the stopper 14 from the initial position to the side of the ink container 7 by driving the driving motor 18. When the light emitting section 21 of the position sensor 9 disposed on the driving shaft 16 reaches the position of the light receiving section 20 of the position sensor 9 disposed on the holding section of the ink container 7 due to the movement of the stopper 14, the position sensor 9 sends a stopper movement detection signal to the position control section 24. When the position control section 24 receives the stopper movement detection signal, the position control section 24 stops the movement of the stopper 14 by stopping the driving of the driving motor 18 and the stopper 14 maintains the position. The stopping position of the stopper 14 is determined beforehand to be where the convex-shaped surface of the stopper 14 contacts the flexible member 12 of the ink container 7, or where the stopper 14 slightly stays away from the flexible member 12 or where the stopper 14 slightly pushes the flexible member 12 when the internal pressure of the ink container 7 is made a negative pressure optimal for printing.

Then, the printing control section 23 opens the valve 11 connecting to the ink tank 10 and fills the ink container 7 with ink by applying pressure, and ejects the ink from the nozzles of the recording head 3. When the ink container 7 is filled with the ink by the pressure, since the stopper 14 restrains the expansion of the flexible member 12 of the ink container 7, the volume of the ink container 7 is maintained at almost the same volume as that at the time when the pressure is made a negative pressure optimal for printing, and the internal pressure of the ink container 7 can become a predetermined high pressure quickly.

In addition, before filling the ink container 7 with ink by pressure, since the stopper 14 restrains the expansion of the flexible member 12 of the ink container 7, it is different from a case where the stopper 14 restrains the expansion of the flexible member 12 of the ink container 7 after starting to fill the ink container 7 with the ink by pressure, so that the ink container 7 is not influenced by a reaction of force when the ink starts to fill the ink container 7 and the resistance to the pressure is small. Therefore, the volume change of the ink container 7 can be easily restrained by a small force, a rapid pressure change in the ink container 7 and the recording head 3 can be prevented, and a reverse flow of ink in the ink supplying tube can be prevented.

After recovering the ink ejection stability of the nozzles of the recording head 3 by ejecting a part of ink in the ink container 7 from the nozzles of the recording head 3, the valve 11 is closed and ink flowing into the ink container 7 is stopped. When the ink flowing into the ink container 7 is stopped, the position control section 24 returns the stopper 14 to the initial position by driving the driving motor 18 (FIG. 2(*a*)). When the stopper 14 is returned to the initial position, a predetermined amount of ink staying in the ink container 7 is discharged from the recording head 3 by a suction method, and the internal pressure of the ink container 7 is made a negative pressure optimal for printing. With this state, printing with the sub tank 2 becomes possible.

As described above, the volume of the ink container 7 at the time when the ink is supplied into the ink container 7 by pressure is maintained at almost the same volume as that at the time when the internal pressure of the ink container 7 is a negative pressure optimal for printing. Therefore, the internal pressure of the ink container 7 can be made a negative pressure optimal for printing by discharging a slight amount of ink from the ink container 7, and the amount of waste ink can be largely reduced. Then, the nozzle surface of the recording head 3 is cleaned by a wiper and the recovering operations of the nozzles of the recording head 3 are finished.

Figure 4:
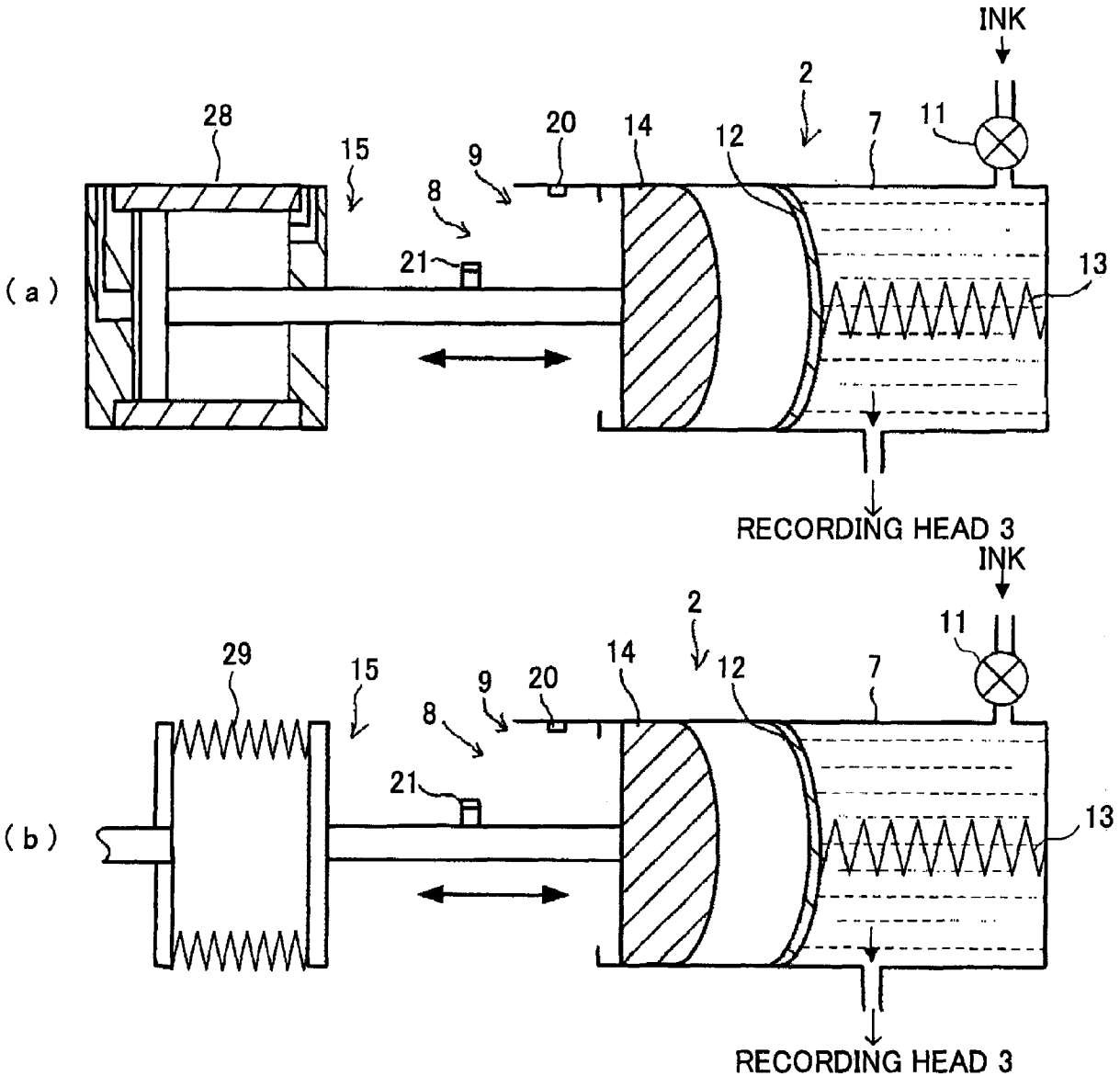
FIG. 4 is a schematic diagram of a sub tank according to a first modified example of the first embodiment of the present invention.

FIG. 4 is a schematic diagram of the sub tank 2 according to a first modified example of the first embodiment of the present invention. In the first embodiment shown in FIG. 2, the stopper 14 is moved by the moving mechanism 15 having the driving motor 18, the pinion 19, and the rack 17. However, in the first modified example of the first embodiment of the present invention, as shown in FIG. 4(*a*), the moving mechanism 15 can be an air cylinder 28, and as shown in FIG. 4(*b*), the moving mechanism 15 can be a bellows 29.

Figure 5:
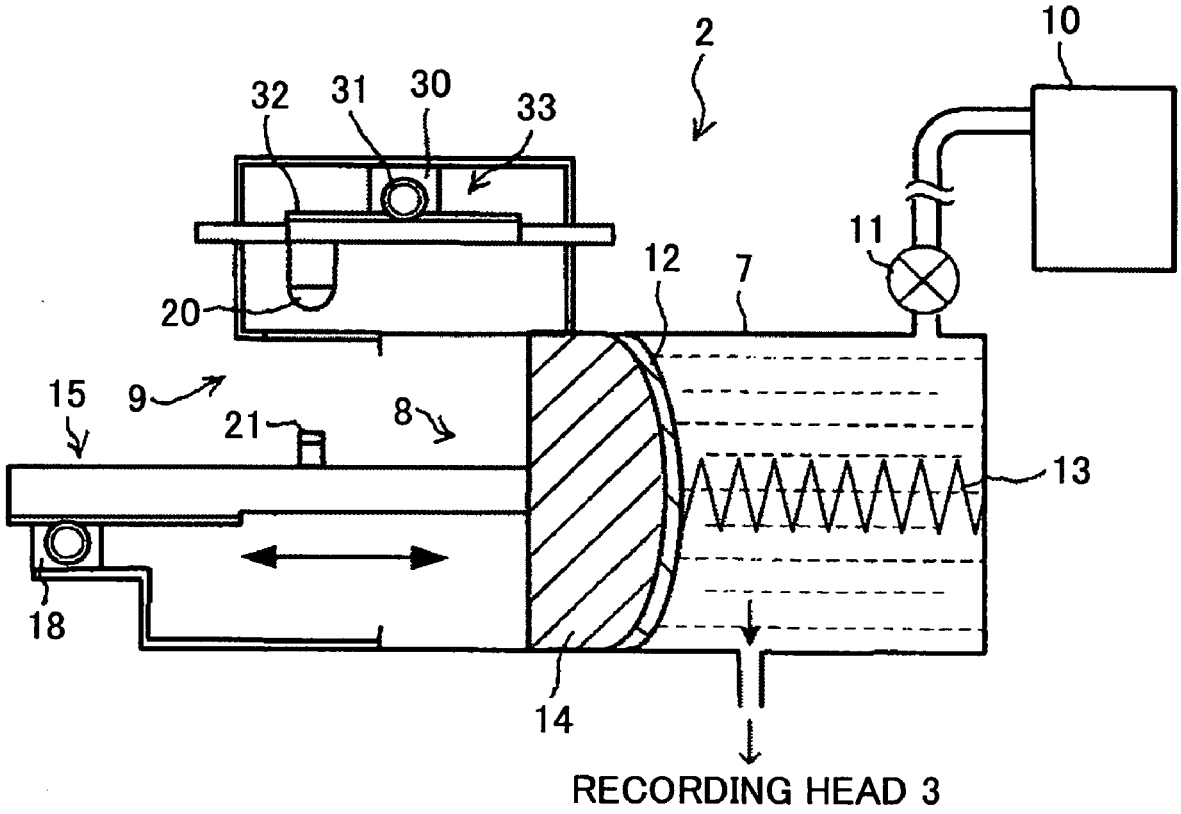
FIG. 5 is a schematic diagram of a sub tank according to a second modified example of the first embodiment of the present invention.

FIG. 5 is a schematic diagram of the sub tank 2 according to a second modified example of the first embodiment of the present invention. In the first embodiment shown in FIG. 2, the position sensor 9 which determines the moving position of the stopper 14 is disposed at a predetermined position. However, in the second modified example of the first embodiment of the present invention, as shown in FIG. 5, the light receiving section 20 is disposed on a sensor position variable unit 33 which includes a position variable motor 30, a pinion 31, and a rack 32. With this, the moving position of the stopper 14 can be variable corresponding to a change of the atmospheric pressure or the temperature. In a case where the moving position of the stopper 14 is variable, when the internal pressure of the ink container 7 is maintained at a negative pressure optimal for printing, even if the volume of the ink container 7 is changed caused by a change of the environment such as the atmospheric pressure or the temperature, an optimal moving position of the stopper 14 can be determined corresponding to the change.

Figure 6:
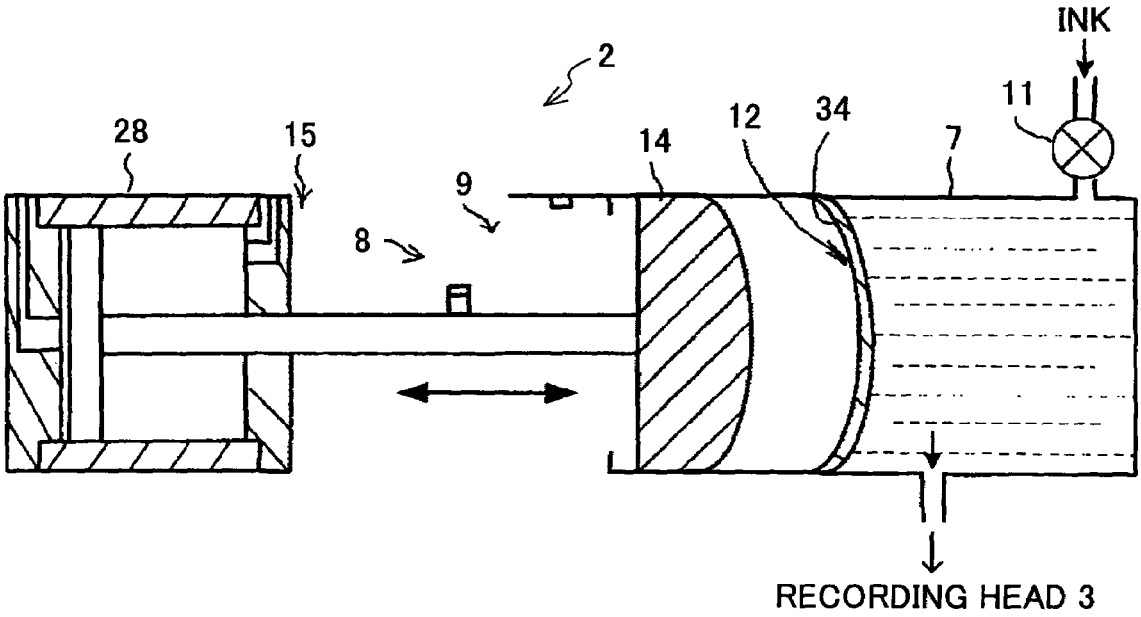
FIG. 6 is a schematic diagram of a sub tank according to a third modified example of the first embodiment of the present invention.

FIG. 6 is a schematic diagram of the sub tank 2 according to a third modified example of the first embodiment of the present invention. In the first embodiment shown in FIG. 2, the flexible member 12 made of, for example, a resin film and the compression spring 13 which pushes the flexible member 12 are disposed in the ink container 7. However, in the third modified example of the first embodiment, as shown in FIG. 6, the flexible member 12 can be formed by a plate spring 34 instead of using the compression spring 13, and the air cylinder 28 is used as the moving mechanism 15.

Figure 7:
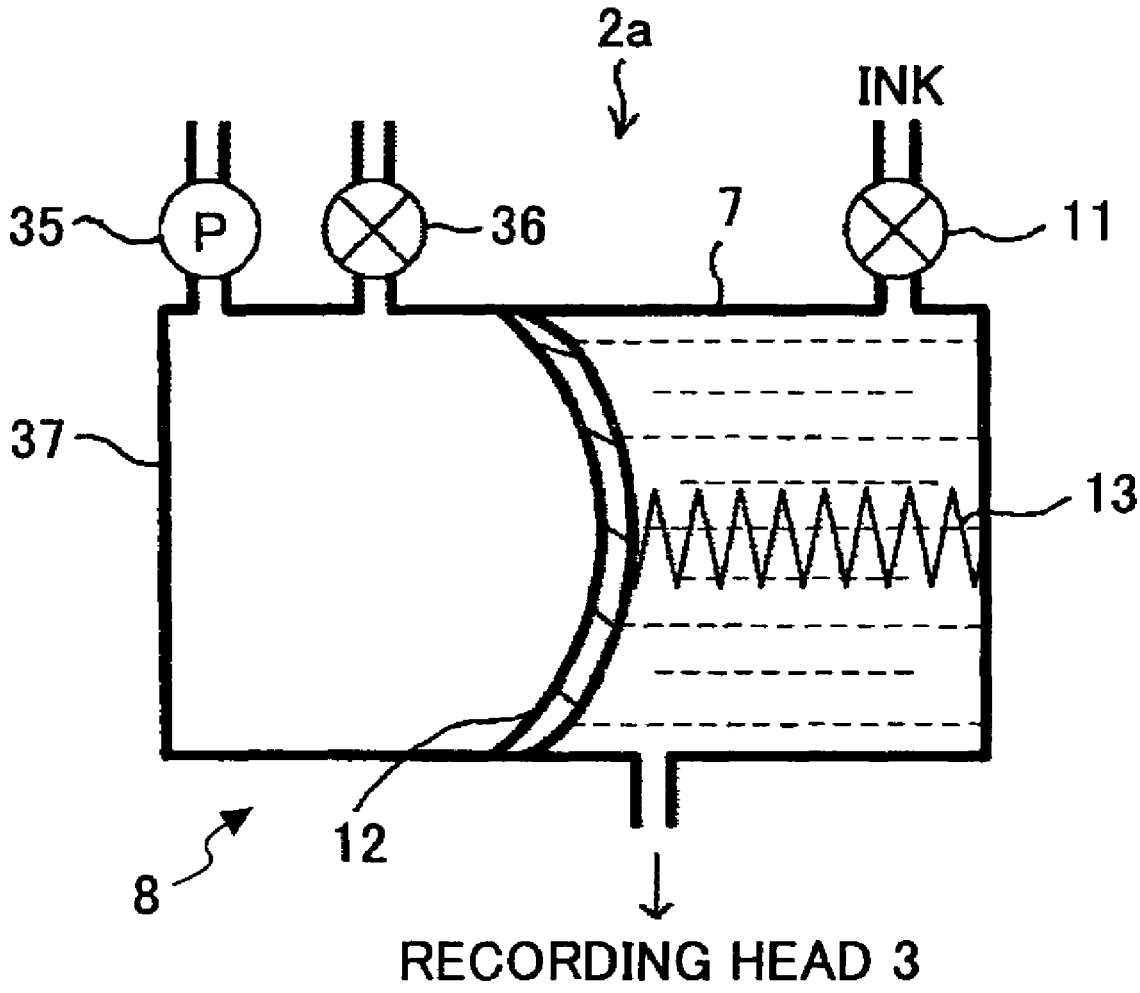
FIG. 7 is a schematic diagram of a sub tank according to a second embodiment of the present invention.

FIG. 7 is a schematic diagram of a sub tank 2*a* according to a second embodiment of the present invention. In the first embodiment shown in FIG. 2, the change of the volume of the ink container 7 is restrained by disposing the stopper 14 and the moving mechanism 15 which moves the stopper 14 in the volume control unit 8. However, in the second embodiment, as shown in FIG. 7, pressure chamber 37 having a fluid supplying pump 35 and an outputting valve 36 is disposed to contact the flexible member 12 of the ink container 7. Then, the change of the volume of the ink container 7 is restrained by controlling the pressure of fluid such as air, gas, water, an organic solvent, or ink supplied in the pressure chamber 37.

In the sub tank 2*a* in which the volume control unit 8 is formed by the pressure chamber 37, in the printing state, the internal pressure of the ink container 7 is maintained at a negative pressure optimal for printing where the inside of the pressure chamber 37 is made the atmospheric pressure by opening the outputting valve 36, when air is used as the fluid.

When the recovering operations of the nozzles of the recording head 3 are executed, fluid is supplied from the liquid supplying pump 35 to the pressure chamber 37 by closing the outputting valve 36; the internal pressure of the pressure chamber 37 which pressure is detected by pressure sensor (not shown) is maintained at almost the same pressure as the internal pressure of the ink container 7 at the time when the recovering operations of the nozzles of the recording head 3 are executed; ink is supplied into the ink container 7 by opening the valve 11 connecting to the ink tank 10; and the ink is ejected from the nozzles of the recording head 3. After recovering the ink ejection stability of the nozzles of the recording head 3 by ejecting a part of ink in the ink container 7 from the nozzles of the recording head 3, the valve 11 is closed and ink flowing into the ink container 7 is stopped. At this time, the ink container 7 is at a positive pressure. Then, the internal pressure of the pressure chamber 37 is made the atmospheric pressure by opening the outputting valve 36 of the pressure chamber 37 and the internal pressure of the ink container 7 is made a negative pressure optimal for printing by discharging ink from the recording head 3 by a suction method. Then, the recovering operations of the nozzles of the recording head 3 are finished by cleaning the nozzle surface of the recording head 3 by a wiper.

As described above, when the recovering operations of the nozzles of the recording head 3 are executed, the volume of the ink container 7 is maintained at almost the same volume as that at the time when the internal pressure of the ink container 7 is a negative pressure optimal for printing by the internal pressure of the pressure chamber 37. Therefore, the internal pressure of the ink container 7 can be made a negative pressure optimal for printing by discharging a slight amount of ink from the ink container 7, and the amount of waste ink can be largely reduced. In addition, after the internal pressure of the pressure chamber 37 is made almost the same pressure as the internal pressure of the ink container 7 when the recovering operations are executed, ink is supplied into the ink container 7 by pressure. Therefore, a breakdown of the recording head 3 can be prevented by decreasing the influence of a rapid increase of pressure in the ink container 7.

In the above description, when the recovering operations of the nozzles of the recording head 3 are executed, ink is supplied into the ink container 7 by pressure after applying pressure to the pressure chamber 37. However, applying pressure to the pressure chamber 37 and supplying ink into the ink container 7 by pressure can be executed at the same time. When applying pressure to the pressure chamber 37 and supplying ink into the ink container 7 by pressure are executed at the same time, the volume of the ink container 7 can be maintained at the same volume as that at the time when the internal pressure of the ink container 7 is a negative pressure optimal for printing when the recovering operations are executed. Therefore, the internal pressure of the ink container 7 can be made a negative pressure optimal for printing by discharging a slight amount of ink from the ink container 7, and the amount of waste ink can be largely reduced.

Figure 8:
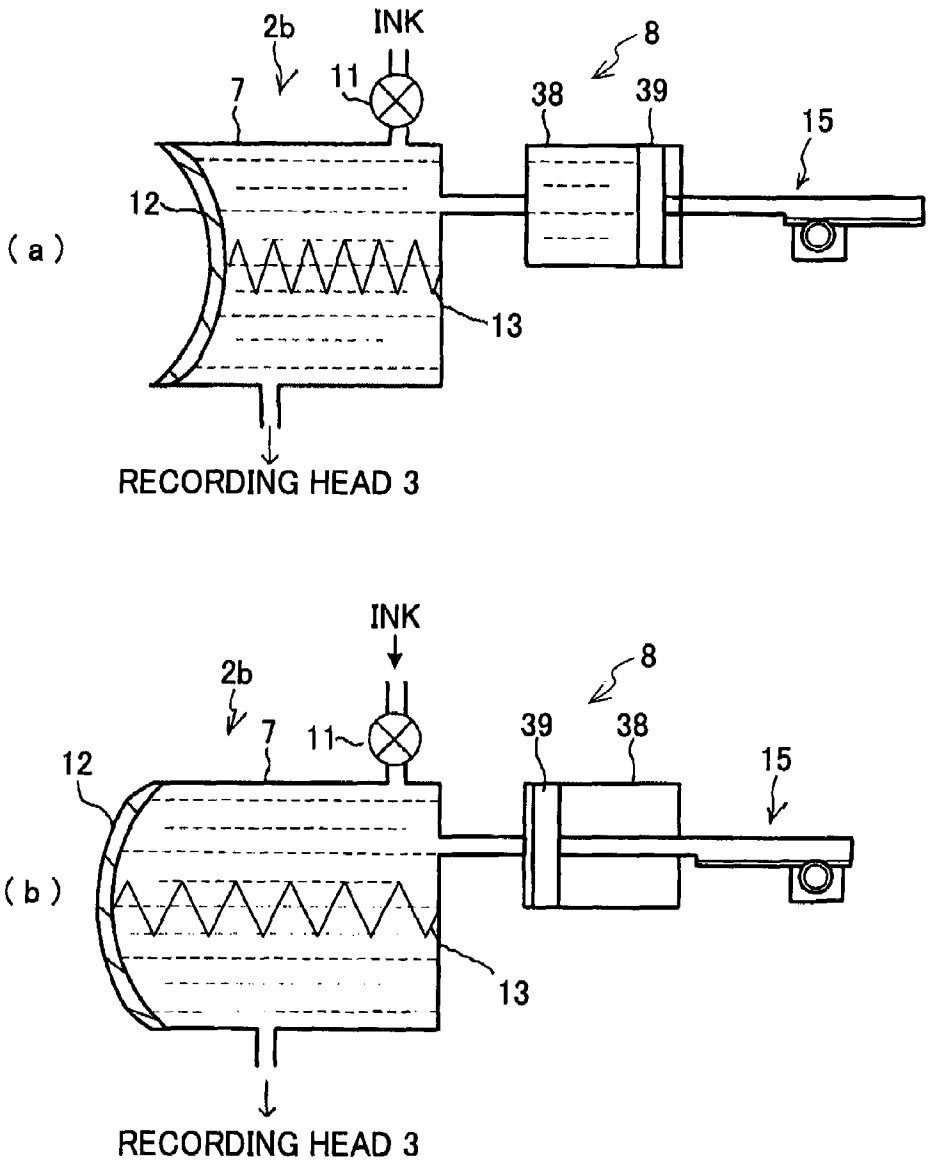
FIG. 8 is a schematic diagram of a sub tank according to a third embodiment of the present invention.

FIG. 8 is a schematic diagram of a sub tank 2*b* according to a third embodiment of the present invention. In FIG. 8, (a) shows the sub tank 2*b* in a printing state and (b) shows a state in which the sub tank 2*b* is in recovering operations of the nozzles of the recording head 3. In FIG. 8, the volume control unit 8 is an ink volume maintaining unit.

As shown in FIG. 8, the volume control unit 8 in the sub tank 2*b* includes an auxiliary tank 38, a piston 39 disposed in the auxiliary tank 38, and the moving mechanism 15 which moves the piston 39. As shown in FIG. 8(*a*), when the sub tank 2*b* is in the printing state, the internal pressure of the ink container 7 is made a negative pressure optimal for printing by running a part of ink in the ink container 7 into the auxiliary tank 38 by the movement of the piston 39. As shown in FIG. 8(*b*), when the sub tank 2*c* is in the recovering operations of the nozzles of the recording head 3, before or when ink is supplied into the ink container 7 by pressure by opening the valve 11 connecting to the ink tank 10, the ink in the auxiliary tank 38 is run again into the ink container 7.

As described above, when the ink run into the auxiliary tank 38 is run again into the ink container 7, the pressure in the ink container 7 can be adjusted and the ink can be used to be ejected from the nozzles of the recording head 3. After recovering the ink ejection stability of the nozzles of the recording head 3 by ejecting a part of the ink in the ink container 7 from the nozzles of the recording head 3, the valve 11 is closed and ink flowing into the ink container 7 is stopped. Then, the internal pressure of the ink container 7 is made a negative pressure optimal for printing by running a part of the ink in the ink container 7 into the auxiliary tank 38 by the movement of the piston 39.

Figure 9:
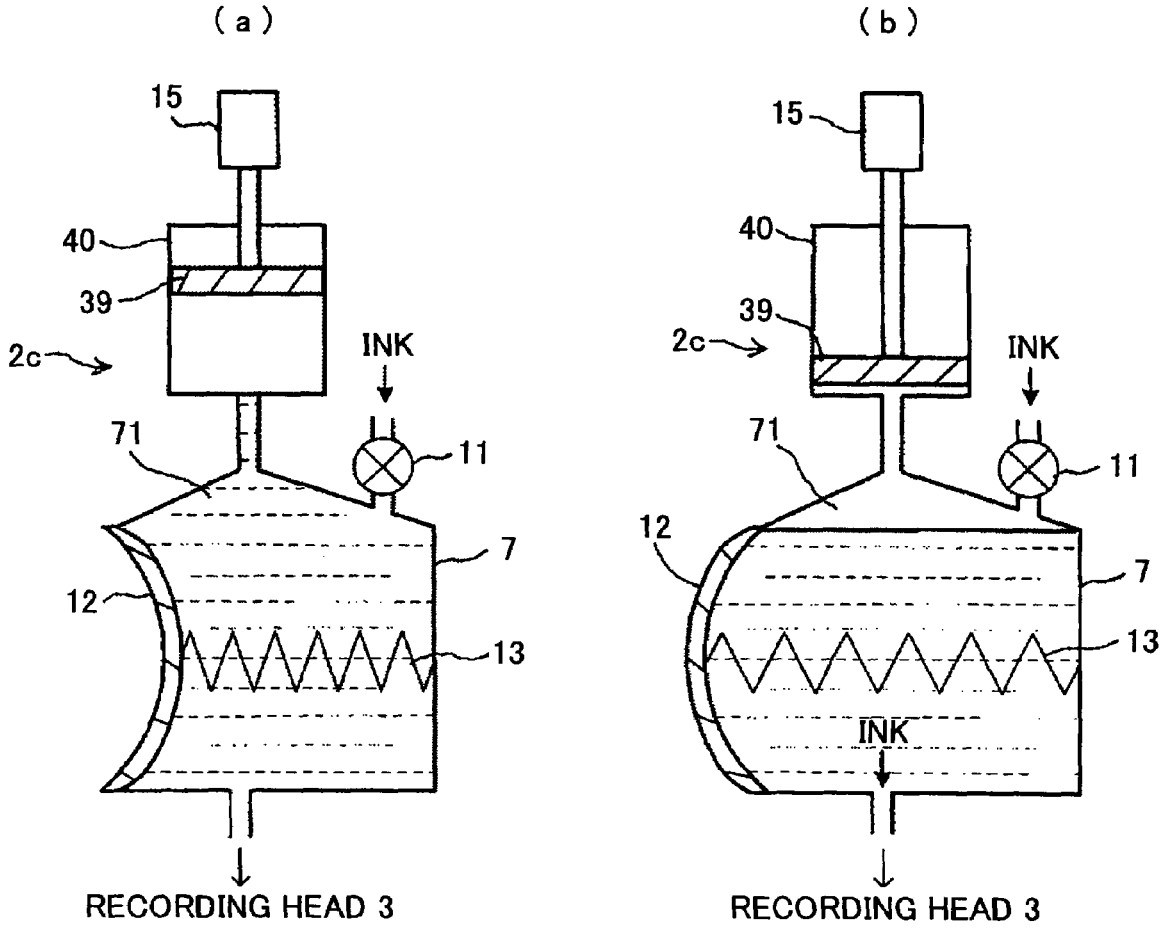
FIG. 9 is a schematic diagram of a sub tank according to a fourth embodiment of the present invention.

FIG. 9 is a schematic diagram of a sub tank 2*c* according to a fourth embodiment of the present invention. In FIG. 9, (a)

shows the sub tank 2*c* in a printing state and (b) shows a state in which the sub tank 2*c* is in recovering operations of the nozzles of the recording head 3.

In the third embodiment shown in FIG. 8, the sub tank 2*b* runs a part of the ink in the ink container 7 into the auxiliary tank 38. However, as shown in FIG. 9, in the fourth embodiment, an ink staying section 71 is formed in the ink container 7 contacting the uppermost position of the flexible member 12. In addition, an auxiliary tank 40 having the piston 39 which moves up and down by the movement of the moving mechanism 15 is disposed so as to connect to the ink staying section 71.

In the sub tank 2*c*, in the printing state, as shown in FIG. 9(*a*), the internal pressure of the ink container 7 is made a negative pressure optimal for printing by supplying ink into the whole region of the ink container 7 including the ink staying section 71 where the piston 39 in the auxiliary tank 40 is moved upward. At this time, an insoluble fluid such as air is supplied in a space between the piston 39 of the auxiliary tank 40 and the ink container 7. As the fluid, carbon dioxide or methane is preferable when water type ink is used.

When the recovering operations of the nozzles of the recording head 3 are executed, as shown in FIG. 9(*b*), before or when ink is supplied into the ink container 7 by pressure by opening the valve 11 connecting to the ink tank 10, the insoluble fluid existing in the space between the piston 39 of the auxiliary tank 40 and the ink container 7 is run into the ink staying section 71 by moving the piston 39 of the auxiliary tank 40 downward. The pressure in the ink container 7 can be adjusted by running the fluid existing in the auxiliary tank 40 into the ink staying section 71. When the insoluble fluid is run into the ink staying section 71, a filter to prevent dust from entering the ink container 7 may be disposed. In this case, it is preferable that the filter be disposed at a position where the insoluble fluid does not enter the ink container 7 by going beyond the ink staying section 71.

After recovering the ink ejection stability of the nozzles of the recording head 3 by ejecting a part of ink in the ink container 7 from the nozzles of the recording head 3, the valve 11 is closed and ink flowing into the ink container 7 is stopped. Then, the internal pressure of the ink container 7 is made a negative pressure optimal for printing by returning the fluid run into the ink staying section 71 to the auxiliary tank 40 by moving the piston 39 of the auxiliary tank 40 upward. That is, the sub tank 2*c* returns to the printing state shown in FIG. 9(*a*).

As described above, when the recovering operations of the nozzles of the recording head 3 are executed, the volume of the ink container 7 is made almost the same volume as that at the time when the internal pressure of the ink container 7 is a negative pressure optimal for printing. Therefore, the internal pressure of the ink container 7 can be made a negative pressure optimal for printing by discharging a slight amount of ink from the ink container 7, and the amount of waste ink can be largely reduced.

Figure 10:
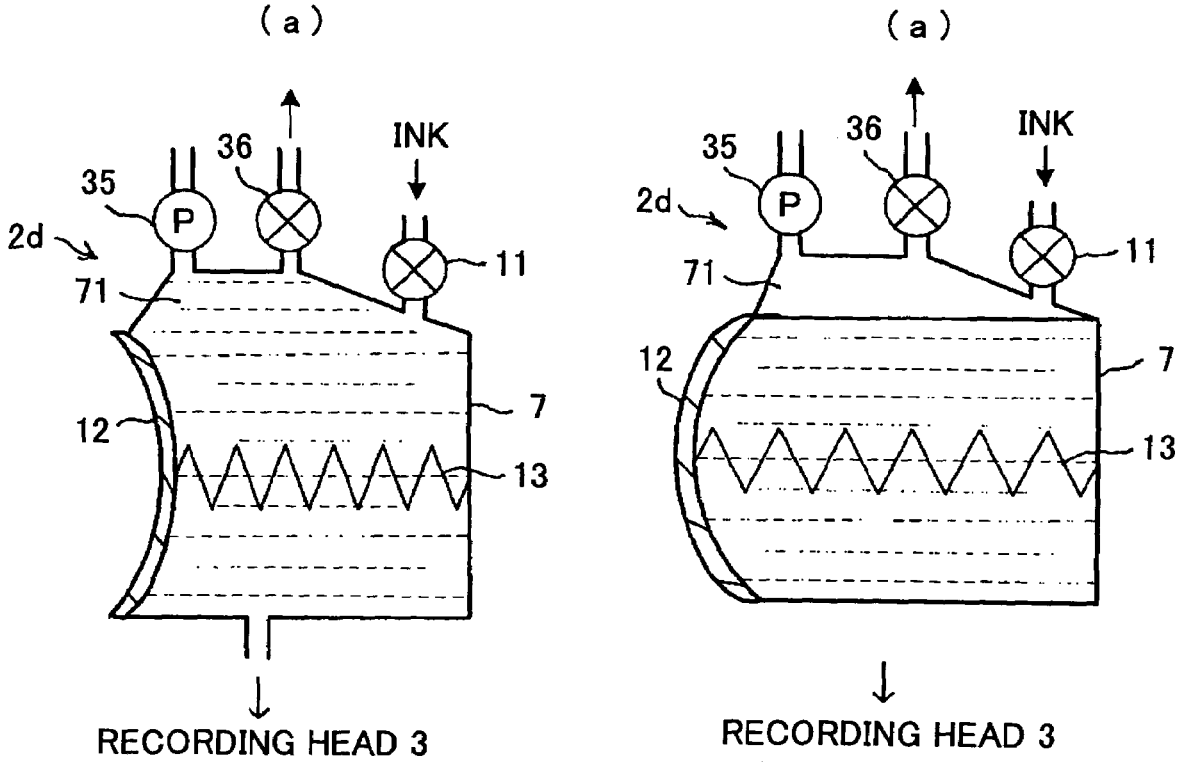
FIG. 10 is a schematic diagram of a sub tank according to a fifth embodiment of the present invention.

FIG. 10 is a schematic diagram of a sub tank 2*d* according to a fifth embodiment of the present invention. In FIG. 10, (a) shows the sub tank 2*d* in a printing state and (b) shows a state in which the sub tank 2*d* is in recovering operations of the nozzles of the recording head 3.

In the fourth embodiment shown in FIG. 9, in the sub tank 2*c*, when the recovering operations of the nozzles of the recording head 3 are executed by using the fluid in the auxiliary tank 40, the volume of the ink container 7 is made almost the same volume as that at the time when the internal pressure of the ink container 7 is a negative pressure optimal for printing. However, in the fifth embodiment, as shown in FIG. 10, a fluid supplying pump 35 and an outputting valve 36 are disposed on the ink staying section 71 of the ink container 7, and as the fluid, insoluble fluid such as air is used.

In the sub tank 2*d*, in the printing state, as shown in FIG. 10(*a*), the internal pressure of the ink container 7 is made a negative pressure optimal for printing by supplying ink into the whole region of the ink container 7 including the ink staying section 71 by opening the valve 11 with the outputting valve 36 closed.

When the recovering operations of the nozzles of the recording head 3 are executed, as shown in FIG. 10(*b*), before or when ink is supplied into the ink container 7 by pressure by opening the valve 11 connecting to the ink tank 10, the insoluble fluid is run into the ink staying section 71 of the ink container 7 from the fluid supplying pump 35 and the pressure in the ink staying section 71 is made almost the same pressure as that of the ink container 7 at the time when the recovering operations are executed. The pressure in the ink container 7 can be adjusted by running the fluid into the ink staying section 71.

After recovering the ink ejection stability of the nozzles of the recording head 3 by ejecting a part of ink in the ink container 7 from the nozzles of the recording head 3, the valve 11 is closed and ink flowing into the ink container 7 is stopped. Then, the internal pressure of the ink container 7 is made a negative pressure optimal for printing by outputting the fluid run into the ink staying section 71 of the ink container 7 by opening the outputting valve 36. That is, the sub tank 2d returns to the printing state shown in FIG. 10(*a*).

Without discarding the waste ink ejected from the nozzles of the recording head 3 during the recovering operations of the nozzles of the recording head 3, when the waste ink is collected in the ink tank 10 by using an ink collecting route (not shown), the ink can be effectively used.

In the embodiments of the present invention, the inkjet recording apparatus 1 of the serial scanning system is described. However, the embodiments of the present invention can be applied to an inkjet recording apparatus of a line head system.

Figure 11:
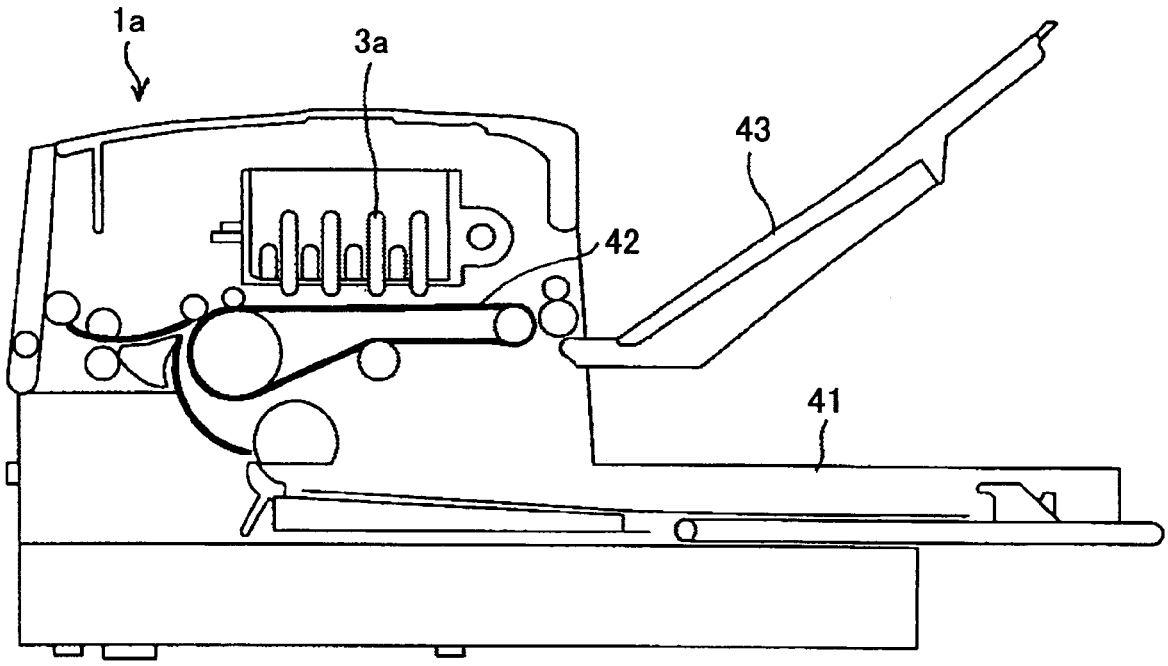
FIG. 11 is a cut-away side view of an inkjet recording apparatus of a line head system.
Figure 12:
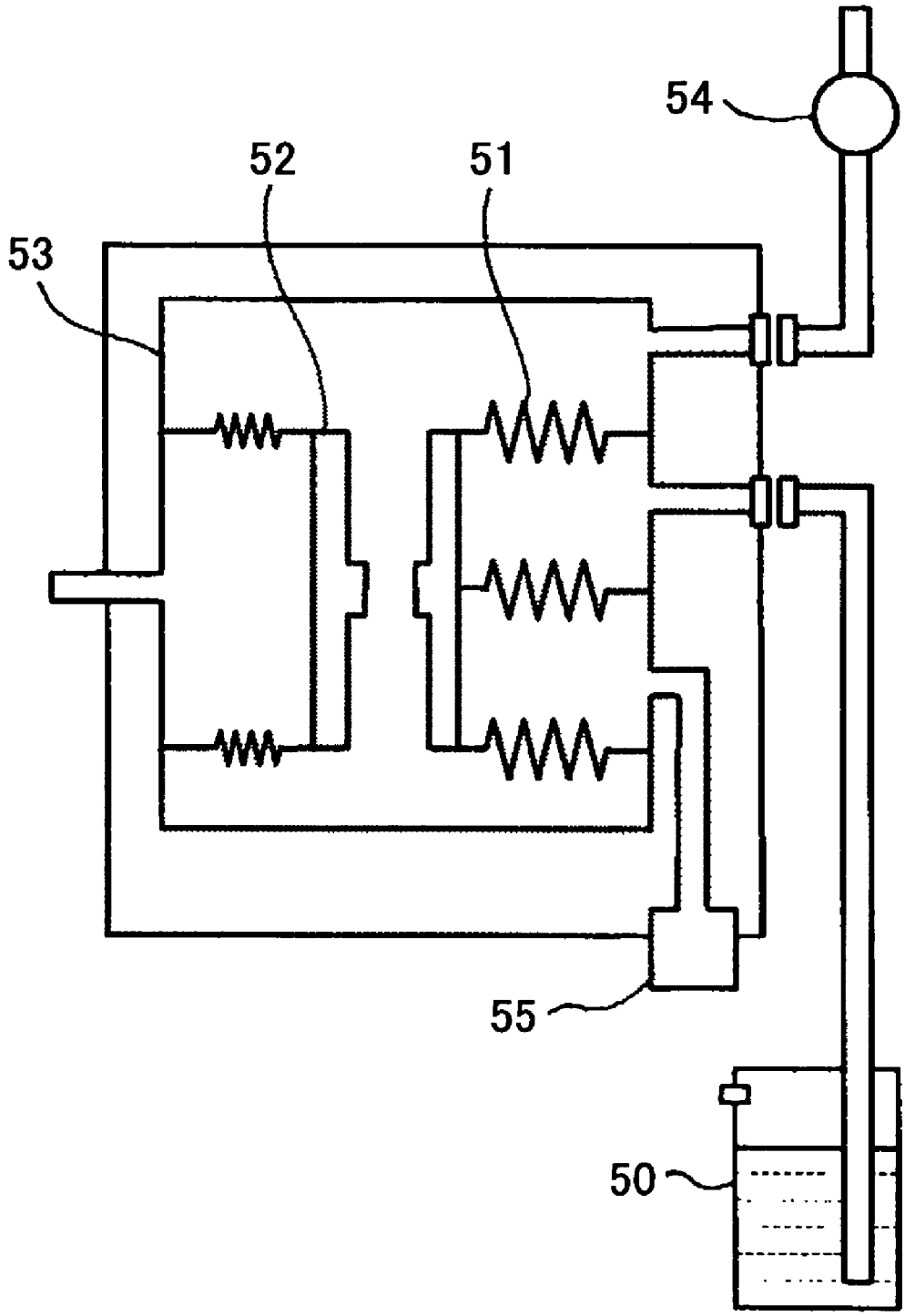
FIG. 12 is a diagram showing a print head unit of an inkjet recording apparatus.

FIG. 11 is a cut-away side view of an inkjet recording apparatus 1*a* of the line head system. As shown in FIG. 11, in the inkjet recording apparatus 1*a*, a recording head 3*a* of a full line type corresponding to the recording width of a recording medium (paper) is disposed, and a letter and/or an image is recorded on the paper (not shown) carried by a carrying belt 42 from a paper feeding tray 41 and the paper on which the letter and/or the image is recorded is output to a paper outputting tray 43. In the inkjet recording apparatus 1*a* of the line head system, the number of nozzles is greater than that of the inkjet recording apparatus 1 of the serial scanning system; therefore, the recovering operations of the nozzles of the recording head 3*a* must be frequently executed. When the amount of the waste ink at the recovering operations is reduced, the consuming amount of the ink can be largely reduced.

In addition, in the inkjet recording apparatus 1*a* of the line head system, without discarding the waste ink ejected from the nozzles of the recording head 3*a* during the recovering operations of the nozzles of the recording head 3*a*, when the waste ink is collected in an ink tank (not shown) by using an ink collecting route (not shown), the ink can be effectively used.

In addition, the present invention can be applied to an image forming apparatus of another system other than the inkjet recording system, and an apparatus which manufactures a component such as an industrial printed circuit board which needs precise processes by ejecting a solvent and so on other than ink.

Further, the present invention is not limited to the specifically disclosed embodiments, and variations and modifications may be made without departing from the scope of the present invention.

The present invention is based on Japanese Priority Patent Application No. 2005-263241, filed on Sep. 12, 2005, with the Japanese Patent Office, the entire contents of which are hereby incorporated by reference.

What is claimed is:

1. An ink supplying container configured to store ink supplied from an ink storing tank and supply the ink to a recording head having nozzles, the ink supplying container comprising:

an ink container including a flexible member at a side of the ink container; and a volume control unit including a stopping unit having a shape conforming to a shape of the flexible member at a time when an internal pressure of the ink container is made a negative pressure, and a moving unit which moves the stopping unit forward or backward for the flexible member of the ink container, wherein:

the volume control unit is disposed to face the flexible member of the ink container, restrains the flexible member from expanding when the internal pressure of the ink container is made a positive pressure, and does not restrain the flexible member from expanding when the internal pressure of the ink container is made the negative pressure, where the negative pressure is lower than atmospheric pressure and the positive pressure is higher than the atmospheric pressure.

2. The ink supplying container as claimed in claim 1, wherein:

the volume control unit does not restrain the flexible member from expanding when the internal pressure is made the negative pressure to eject the ink by the recording head for printing, and the volume control unit restrains the flexible member from expanding when the internal pressure is made the positive pressure to clean and recover the nozzle of the recording head.

3. The ink supplying container as claimed in claim 1, wherein:

the volume control unit includes a position detecting unit which determines a position where the stopping unit is stopped when the stopping unit is moved forward to the flexible member.

4. The ink supplying container as claimed in claim 3, further comprising:

a position variable unit which makes the position where the position detecting unit is disposed variable.

5. The ink supplying container as claimed in claim 1, wherein:

the volume control unit further includes a pressure chamber which contacts the flexible member of the ink container and makes the internal pressure of the pressure chamber the atmospheric pressure when the internal pressure of the ink container is made the negative pressure and applies pressure to the inside of the pressure chamber when the internal pressure of the ink container is made the positive pressure.

6. The ink supplying container as claimed in claim 5, wherein:

when pressure is applied to the inside of the pressure chamber, the volume control unit makes the internal pressure of the pressure chamber almost the same pressure as the internal pressure of the ink container at the time when the internal pressure of the ink container is made the positive pressure.

7. An image forming apparatus, comprising:

a recording head having nozzles;

an ink supplying container configured to store ink supplied from an ink storing tank and supply the ink to the recording head, the ink supplying container having:

an ink container including a flexible member at a side of the ink container; and a volume control unit being disposed to face the flexible member of the ink container, the volume control unit restraining the flexible member from expanding when an internal pressure of the ink container is made a positive pressure, and does not restrain the flexible member from expanding when the internal pressure of the ink container is made a negative pressure where the negative pressure is lower than atmospheric pressure and the positive pressure is higher than the atmospheric pressure, wherein:

the volume control unit does not restrain the flexible member from expanding when the internal pressure is made the negative pressure to eject the ink by the recording head for printing, and the volume control unit restrains the flexible member from expanding when the internal pressure is made the positive pressure to clean and recover the nozzle of the recording head.

8. The image forming apparatus as claimed in claim 7, further comprising:

a stopping unit having a shape conforming to a shape of the flexible member at a time when the internal pressure of the ink container is made the negative pressure; and a moving unit which moves the stopping unit forward or backward relative to the flexible member of the ink container.

9. The image forming apparatus as claimed in claim 7, further comprising:

a position detecting unit which determines a position where the stopping unit is stopped when the stopping unit is moved forward towards the flexible member.

10. The image forming apparatus as claimed in claim 9, further comprising:

a position variable unit which makes a position where the position detecting unit is disposed variable.

* * * * *